US007565904B2

(12) United States Patent
Hoffman et al.

(10) Patent No.: US 7,565,904 B2
(45) Date of Patent: Jul. 28, 2009

(54) FIRELOG BURNER

(75) Inventors: Paul J. Hoffman, Chicago, IL (US); John DeSautels, Mill Creek, WA (US)

(73) Assignee: Fire Designs, LLC, Shelbyville, KY (US)

( * ) Notice: Subject to any disclaimer, the term of this patent is extended or adjusted under 35 U.S.C. 154(b) by 0 days.

(21) Appl. No.: 11/123,296

(22) Filed: May 6, 2005
(Under 37 CFR 1.47)

(65) Prior Publication Data

US 2006/0037603 A1 Feb. 23, 2006

Related U.S. Application Data

(60) Provisional application No. 60/568,995, filed on May 7, 2004.

(51) Int. Cl.
*F23H 17/08* (2006.01)

(52) U.S. Cl. ..... 126/153; 126/152 B; 126/540; 126/541

(58) Field of Classification Search ..... 126/153, 126/152 B, 540, 541, 298
See application file for complete search history.

(56) References Cited

U.S. PATENT DOCUMENTS

| | | | |
|---|---|---|---|
| 3,042,109 | A | 7/1962 | Peterson |
| 3,291,116 | A | 12/1966 | Brooks |
| 3,377,229 | A | 4/1968 | Bryan |
| 3,508,536 | A | 4/1970 | McEwan |
| 3,817,686 | A | 6/1974 | Quittner |
| 3,993,430 | A | 11/1976 | Forker |
| 4,000,732 | A | 1/1977 | White |
| 4,060,396 | A | 11/1977 | Burton |
| 4,076,490 | A | 2/1978 | Hilker |
| 4,305,375 | A | 12/1981 | George |
| 4,344,412 | A | 8/1982 | Perrin |

(Continued)

FOREIGN PATENT DOCUMENTS

| | | |
|---|---|---|
| EP | 0096111 | 12/1983 |

OTHER PUBLICATIONS

CSN Fireplaces, a division of CSN Stores, Inc., *Fireplaces and Stoves*, Copyright 2002-2005 by CSN Fireplaces, a division of CSN Stores, Inc., posted on the Internet at http://www.csnfireplaces.com/Fireplaces-and-Stoves-C9342T1.html.

(Continued)

*Primary Examiner*—Alfred Basichas
(74) *Attorney, Agent, or Firm*—Wood, Herron & Evans, LLP

(57) ABSTRACT

A firelog burner is provided that includes a base and an artificial firelog support frame pivoted to the base. A pair of non-burning artificial firelogs are removably mounted on the support frame. The base has a fire directing member extending along a back thereof and in an upward direction for directing flame between the artificial fire logs. The non-burning artificial fire logs in the support frame are operably pivoted above the base and toward the flame directing member to raise the support frame and the non-burning artificial firelogs for the insertion of placement of a burning artificial firelog in the base. The firelogs and support frame may then be pivoted in the opposite direction to an operating position.

8 Claims, 6 Drawing Sheets

U.S. PATENT DOCUMENTS

| | | | | |
|---|---|---|---|---|
| 4,573,905 | A | 3/1986 | Meyers | |
| 4,582,478 | A | 4/1986 | Hilker | |
| 4,637,372 | A | 1/1987 | Mogol et al. | |
| 4,838,781 | A | 6/1989 | Fischer | |
| 4,883,043 | A | 11/1989 | Thow et al. | |
| 4,962,750 | A | 10/1990 | Bridgewater | |
| 5,067,476 | A | 11/1991 | Rhodes, Jr. | |
| 5,081,981 | A * | 1/1992 | Beal | 126/92 R |
| 5,118,539 | A | 6/1992 | Sebby et al. | |
| 5,284,686 | A | 2/1994 | Thow | |
| 5,423,310 | A * | 6/1995 | Hudson et al. | 126/512 |
| 5,435,295 | A * | 7/1995 | Gerrard | 126/541 |
| 5,769,623 | A | 6/1998 | Lake et al. | |
| D427,298 | S | 6/2000 | Maust et al. | |
| 6,102,032 | A | 8/2000 | Sebby et al. | |
| 6,260,548 | B1 * | 7/2001 | Wade | 126/512 |
| 6,267,113 | B1 | 7/2001 | Maust et al. | |
| 6,363,927 | B2 | 4/2002 | Haynes et al. | |
| 6,521,001 | B2 | 2/2003 | Mathew et al. | |
| 6,886,555 | B2 * | 5/2005 | Lee | 126/541 |

OTHER PUBLICATIONS

New Beginnings Management Company, Inc., *Firelog Mate*, Copyright 2004 by New Beginnings Management Company, Inc., posted on the Internet at http://www.comfortglow.com/fireplaces/flmate.html.

Contractors Depot, *The Firelog Enhancer*, Copyright 2005 by Contractors Depot based on Home Page, posted on the Internet at http://www.firelog-enhancer-grate.com; http://www.firelog-enhancer-grate.com/features1.htm; and http://www.firelog-enhancer-grate.com/components.htm.

Acantha Lifestyle, *Style that Inspires*, date of posting on Internet not known, posted on Internet at http://www.acanthafireplaces.com/index.html.

Paul J. Hoffmann et al., *Fuel Burning Logset and Hearth*, co-pending U.S. Appl. No. 11/123,365, filed May 6, 2005.

* cited by examiner

FIRELOG BURNER

CROSS-REFERENCES

This application claims the priority benefit of U.S. Provisional Patent Application Ser. No. 60/568,995, "Firelog Burner", filed May 7, 2004, which is expressly incorporated by reference herein in its entirety.

FIELD OF THE INVENTION

This invention relates to firelog burners and in particular to apparatus for enhancing the aesthetics produced with the burning of an artificial firelog, such as, for example, the "PINEMOUNTAIN" brand artificial fire log made by the Conros Corporation of North York, Ontario, or the Duraflame firelog distributed by Duraflame, Inc. of Stockton, Calif. The invention is useful for burning suitable artificial or synthetic firelogs of other companies as well.

BACKGROUND

It will be appreciated that artificial firelogs have been in the market for some time. These comprise an artificial firelog of substantially similar length to a chopped piece of firewood. Such artificial firelogs are made of sawdust or other cellulosic materials and may be treated with various chemicals to promote or suppress particular burning rates. Such firelogs are frequently used in regular fireplaces and are simply placed on the grate and then lighted in order to provide a fire in that fireplace, without the use of natural cut wood.

When such firelogs are burned without other combustible materials, they do produce a flame and heat, however, the aesthetics of such burning firelogs are not up to the same quality as natural logs burning. It is thus desirable to enhance the aesthetics of the burning of an artificial firelog.

SUMMARY

In view of the foregoing, the invention contemplates a firelog burner providing non-burning simulated log members around which flames are directed from the artificial firelog to create the aesthetics of a naturally burning fire.

The firelog burner of the present invention includes a base and an artificial firelog support frame pivotally mounted on the base. A pair of non-burning artificial firelogs are removably mounted on the support frame. The base has a fire directing member extending along a back of the base and in an upward direction for directing flame upward toward at least one of the artificial firelogs. The non-burning artificial firelogs and the support frame are operably pivoted above the base and toward the flame directing member to raise the support frame and the non-burning artificial firelogs for the insertion and placement of a burning artificial firelog in the base.

The base can further include first and second spaced apart legs and a bin supported by the legs, with the bin being operably effective for receiving a burning artificial log. The bin can include a plurality of apertures formed therein, with the apertures being operably effective for letting ashes from a burning artificial firelog fall through the bin.

The firelog burner can also include a handle integral with the support frame, with the handle being operably effective for facilitating the pivoting of the support frame relative to the base. Accordingly, the handle can be used to facilitate the upward motion of the support frame away from the base, so that an artificial firelog can be inserted in the bin of the base at the appropriate time.

The support frame can include first and second legs with each of the non-burning artificial firelogs being removably mounted on one of the support frame legs. This can be accomplished with clips secured to each of the support frame legs and apertures formed in the firelogs. When the support frame is pivoted downwardly to an operating position, the two non-burning artificial firelogs are positioned over the artificial firelog contained within the bin. When the artificial firelog is lit, the flames are directed upwardly toward the two non-burning log members and to the rear of the upper log member, creating the aesthetic appearance of a naturally burning fire. The two non-burning log members are manufactured from any suitable synthetic material such as a fiber-ceramic log set and are colored in any suitably known way to have the appearance of a real burning wood log.

The firelog burner is particularly useful for placing on the standing grate of a regular fireplace and, when so used, and an artificial firelog burned therein, an appearance of a natural and warm flickering flame fire is provided. Use of the firelog burner provides a natural looking fire with very little upkeep maintenance or fire maintenance.

Accordingly, the invention provides an apparatus for enhancing the aesthetic appearance of an artificial firelog by providing a support for the log, coupled with independent and non-burning artificial log members which are provided with the appearance of burning as the artificial firelog burns.

BRIEF DESCRIPTION OF THE DRAWINGS

These and other features, aspects, and advantages of the present invention will become better understood with regard to the following description, appended claims and accompanying drawings wherein:

DETAILED DESCRIPTION

Figure 1:
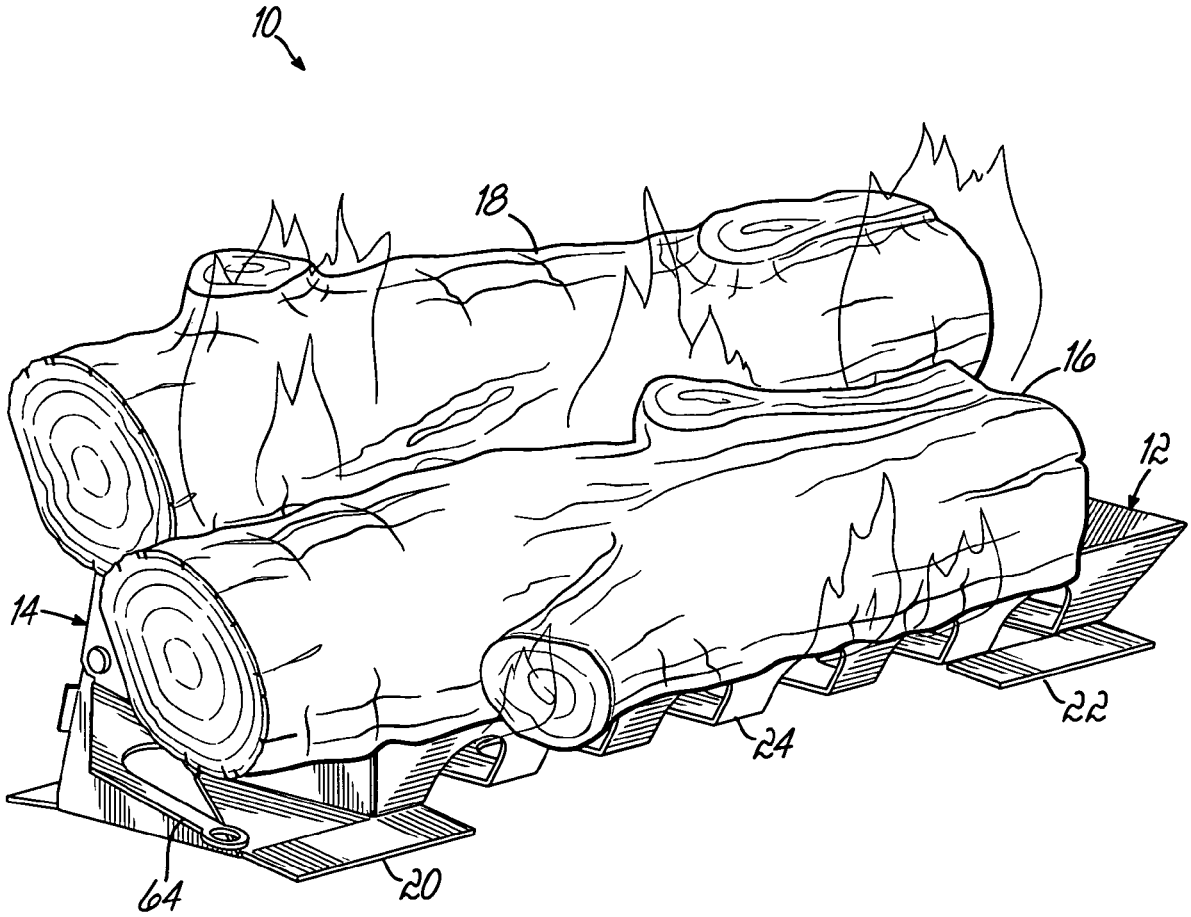
FIG. 1 is an isometric view of a firelog burner according to one embodiment of the present invention.
Figure 2A:
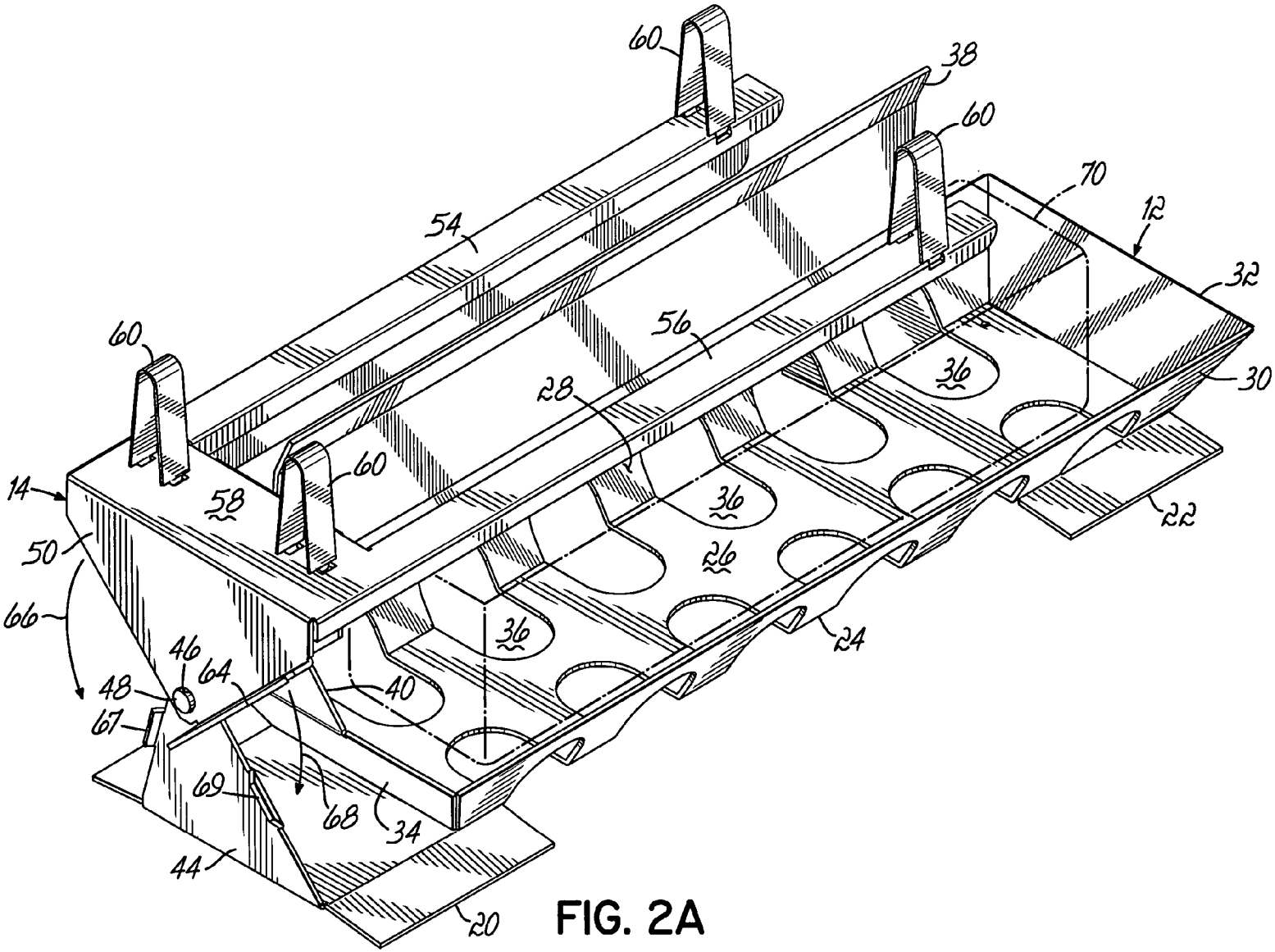
FIG. 2A is an isometric view of the firelog burner shown in FIG. 1, but with the two non-burning artificial firelogs removed for the purposes of illustration.
Figure 2B:
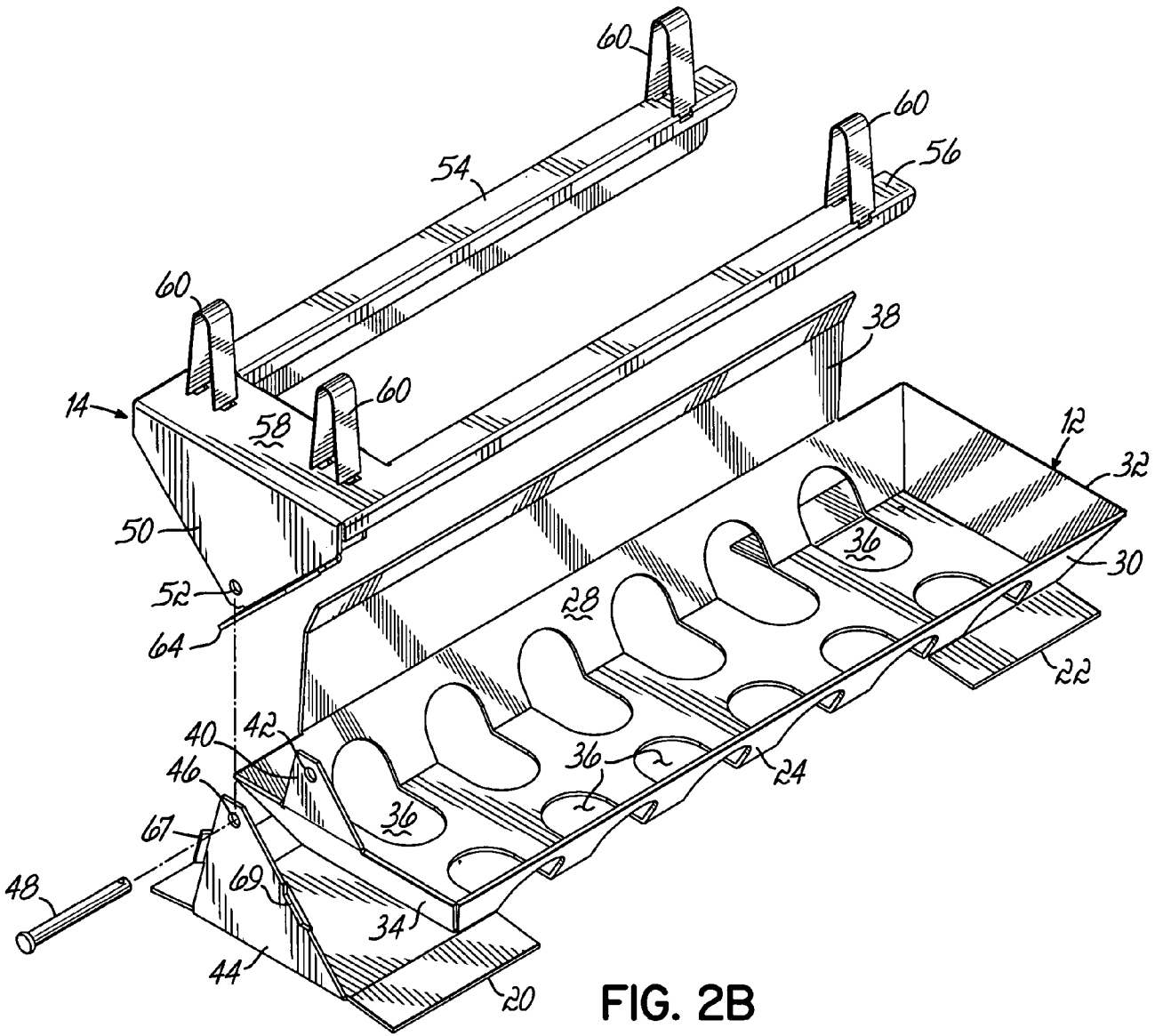
FIG. 2B is an isometric, exploded assembly view of the firelog burner shown in FIGS. 1 and 2A with the two non-burning artificial firelogs removed for the purposes of illustration.
Figure 4:
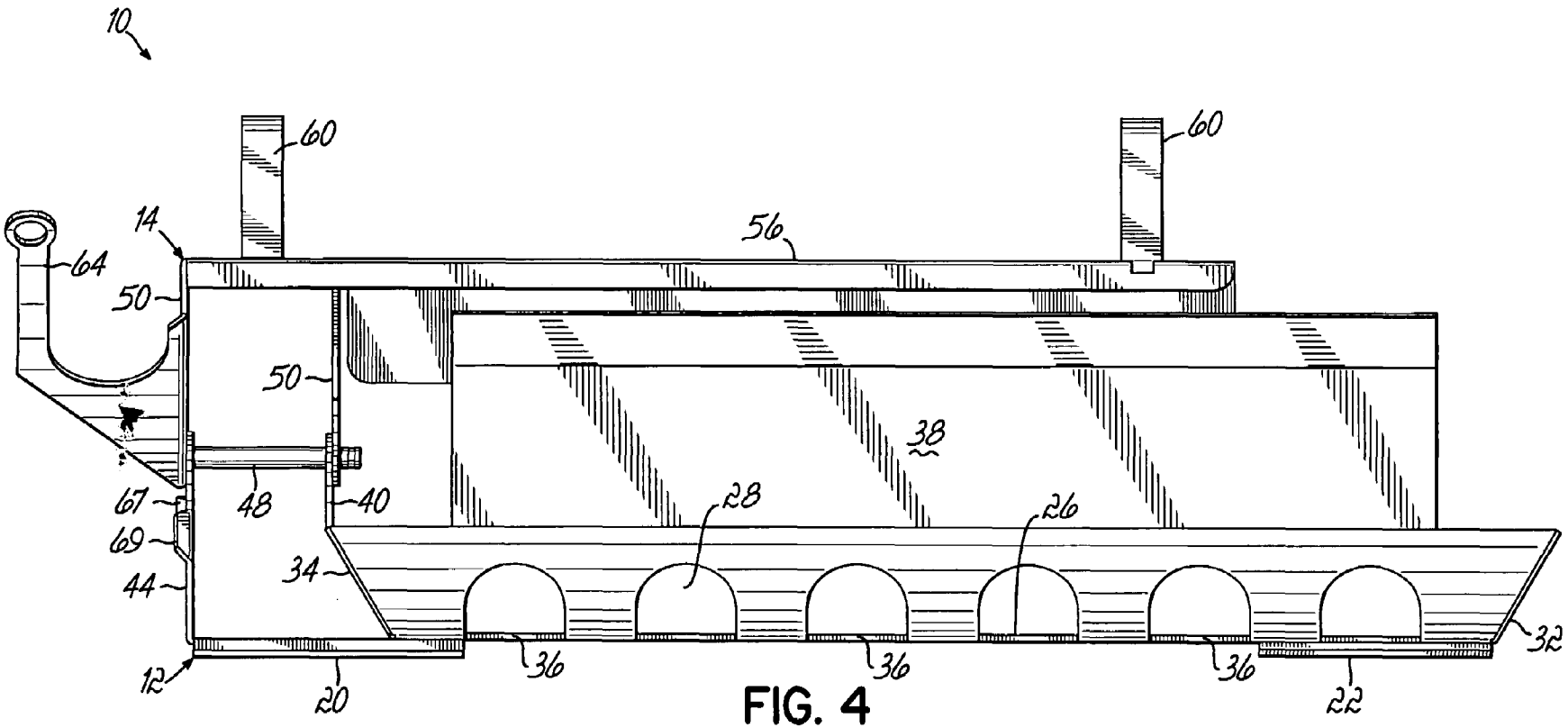
FIG. 4 is a front elevation view of the firelog burner shown in FIG. 1, with the non-burning artificial firelogs removed for purposes of illustration.

Referring now to the drawings, FIG. 1 is an isometric view illustrating a firelog burner 10 according to one embodiment of the present invention. The firelog burner 10 includes a base 12 and an artificial firelog support frame 14 pivotally connected to the base 12. The firelog burner 10 further includes a non-burning artificial firelog 16 and a second non-burning artificial firelog 18, with each of the non-burning artificial firelogs 16, 18 being removably mounted on the support frame 14 as subsequently discussed. Referring now to FIGS. 2A, 2B and 4, the base 12 includes a first leg 20 and a second leg 22 spaced apart from the first leg 20. The base 12 also includes a bin 24 that is supported by the legs 20 and 22. The bin includes a floor 26, first 28 and second 30 opposing sidewalls that extend upwardly from the floor 26 and opposing ends 32 and 34 that also extend upwardly from the floor 26 and are integral with the sides 28 and 30. The bin includes a plurality of apertures 36 formed therein that are effective for letting ashes of any burning member fall through the bin 26.

The base 12 also includes a fire directing member 38 extending along a back of the base. In the illustrative embodiment, the fire directing member 38 extends along the rear wall 28 of bin 24 and in an upward direction for subsequently described purposes. In other embodiments, a fire directing member may be provided that is separate from the bin 24. Bin 24 includes an upwardly extending flange 40 having an aperture 42 formed therein and leg 20 of base 12 includes an upwardly extending flange 44 with an aperture 46 formed therein. The apertures 42 and 46 are generally aligned with one another so that they may accept a hinge pin 48 therethrough. The support frame 14 includes a pair of downwardly extending flanges 50 as best seen in FIG. 4. Each of the flanges 50 has an aperture 52 (one shown) formed in a lower portion thereof. The support frame 14 is pivotally connected to the base 12 and this is accomplished in the illustrative embodiment as follows. The flanges 50 of the support frame are positioned so that one of the flanges 50 is disposed adjacent flange 40 of bin 24 with the other flange 50 being disposed adjacent flange 44 of leg 20 of base 12, so that the apertures 52 in the flanges 50 are aligned with the apertures 46 and 42 in flanges 44 and 40, respectively. Hinge pin 48 passes through each of the apertures 52 as well as the apertures 46 and 42, and can be secured in any conventional manner, thereby pivotally mounting the support frame 14 on the base 12.

Support frame 14 includes first 54 and second 56 legs spaced apart from one another as best seen in FIGS. 2A and 2B. The legs 54 and 56 are interconnected by a cross member 58. A plurality of clips 60 are secured to the support frame 14, with at least one clip 60 being secured to each of the legs 54 and 56. Each of the non-burning artificial firelogs 16 and 18 include a pair of apertures 62 (one for each firelog shown) formed therein. Each of the clips 60 are inserted into one of the apertures 62 thereby removably mounting the firelogs 16 and 18 to the support frame 14.

Figure 3A:
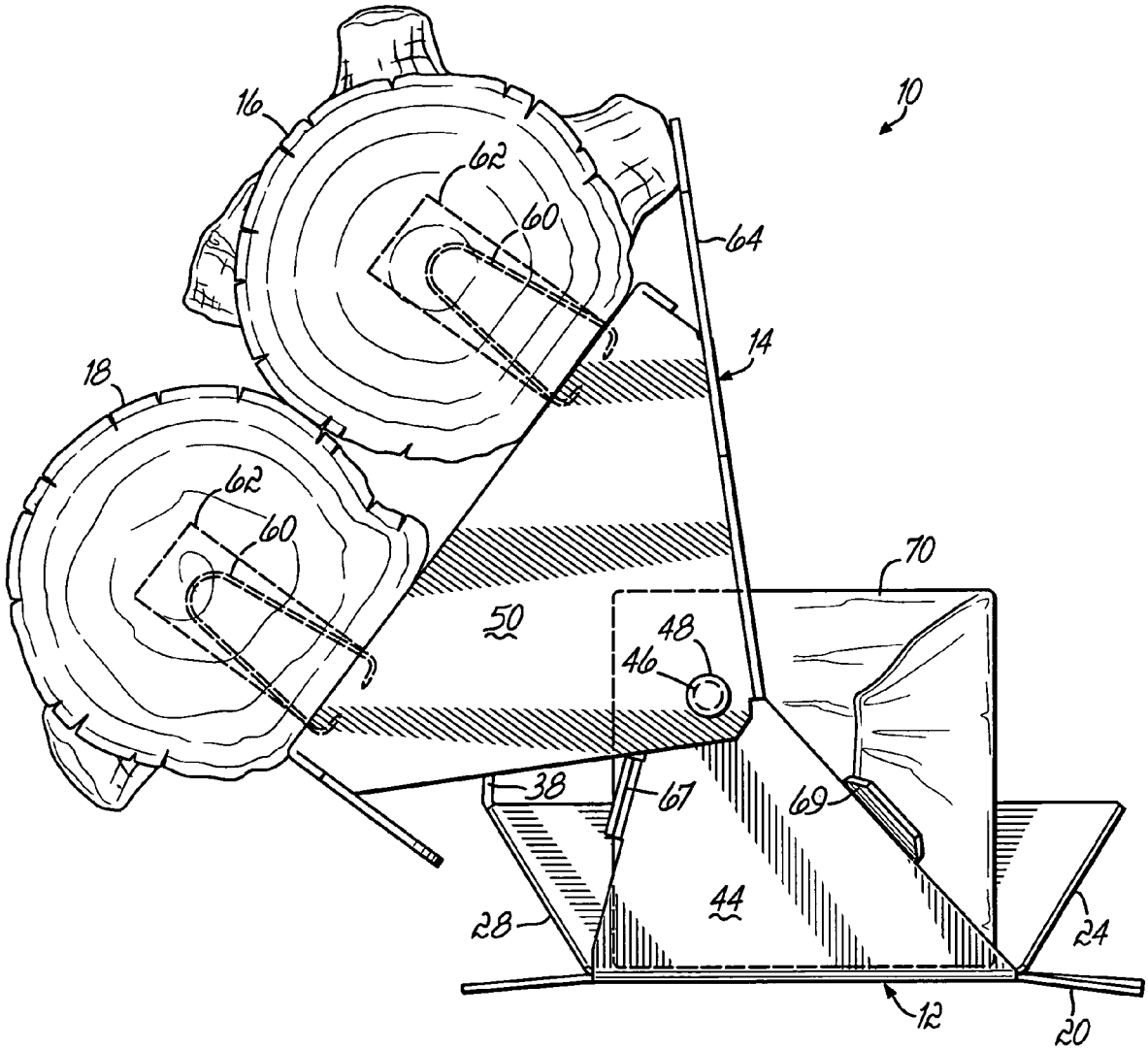
FIG. 3A is a side elevation view of the firelog burner shown in FIG. 1, with the support frame and the two non-burning artificial firelogs pivoted upward away from the base to permit insertion of a burning artificial firelog in the base.
Figure 3B:
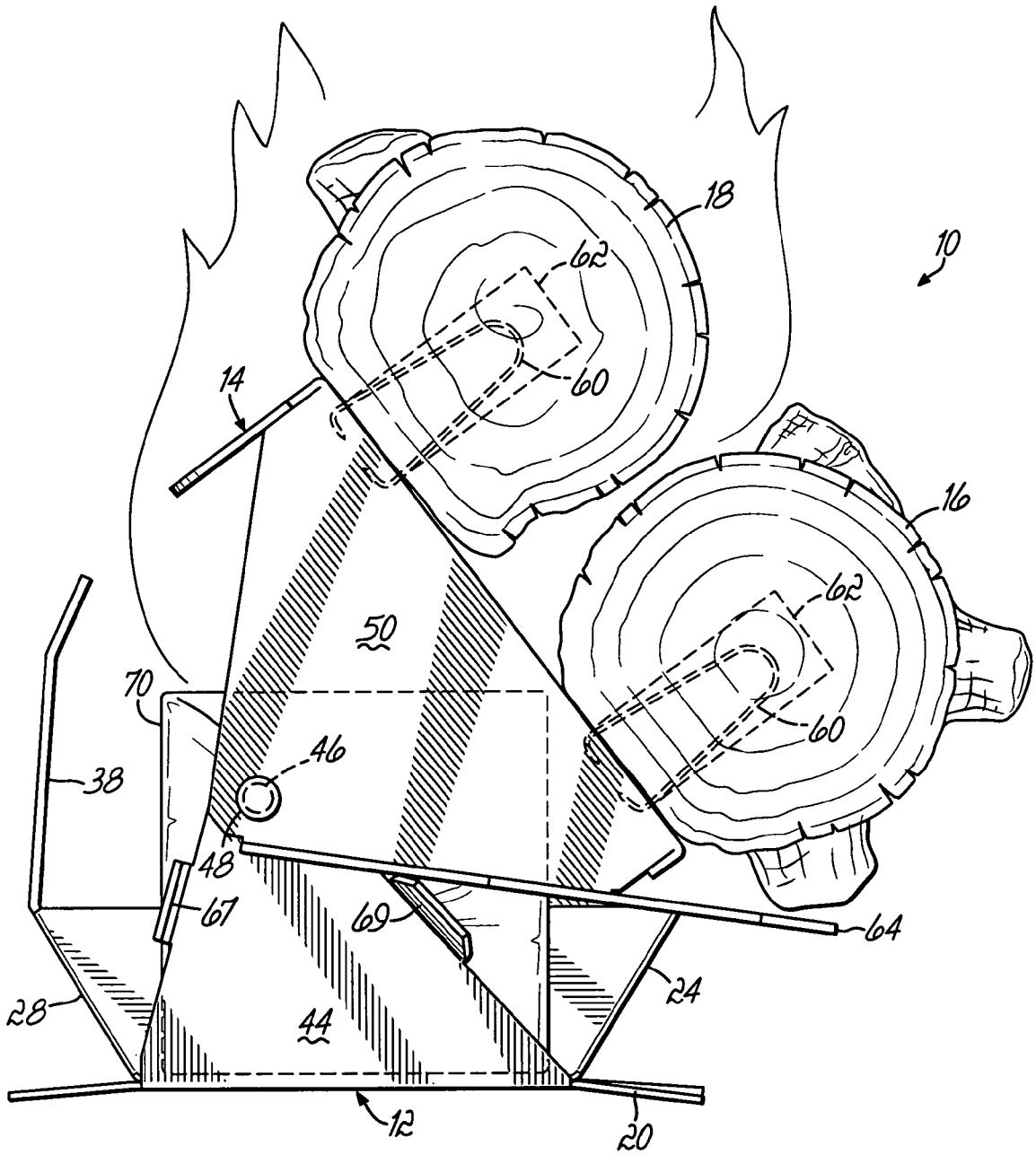
FIG. 3B is a side elevation view similar to FIG. 3A, but with the support frame and non-burning artificial firelogs rotated forward in an operating condition.

The firelog burner 10 also includes a handle 64 which is integral with the flange 50 of the support frame 14. Accordingly, handle 64 is operably effective for pivoting the support frame 14 and the non-burning artificial firelogs 16 and 18 from one position to another. For instance, the support frame 14 and firelog 16, 18 may be pivoted in a counter clockwise direction as indicated by direction narrow 66 in FIG. 2A so that the support frame 14 and firelogs 16 and 18 are in a loading position, such as that shown in FIG. 3A. A stop 67 integral with flange 44 limits the amount of allowable rotation in direction 66. In this position, an artificial firelog 70 can be inserted into the bin 24 of base 12. For example, the artificial firelog 70 can be a firelog such as the "PINE MOUTAIN" brand artificial firelog made by the Conros Corporation of North York, Ontario, or the "DURAFLAME" firelog distributed by Duraflame, Inc. of Stockton, Calif. After the firelog 70 has been loaded into the bin 24, the handle 64 may be used to rotate the support frame 14 and the artificial firelogs 16 and 18 in a clockwise direction as indicated by direction narrow 68 in FIG. 2A, to an operating position such as the position shown in FIG. 3B. A stop 69 integral with flange 44 limits the amount of allowable rotation in direction 68. In this position, the firelogs 16 and 18 obscure at least a portion of the firelog 70 and are positioned relative to the bin so as to permit flames to flicker upward and between the firelogs 16 and 18 and around the rear of firelog 18. The fire directing member 38 assists in directing the flames upward around the rear of the firelog 18. The structural features of the firelog burner 10 of the present invention that permit the foregoing flame paths significantly enhance the aesthetics of the burning of the artificial firelog 70.

These and other modifications and alternative embodiments will be readily apparent to one of ordinary skill in the art without departing from the scope of this invention and applicant intends to be bound only by the claims appended hereto.

What is claimed is:

1. A firelog burner comprising:

a base and an artificial firelog support frame pivotally mounted on said base;

a pair of non-burning artificial firelogs removably mounted on said support frame;

said base having a fire directing member extending along a back thereof and in an upward direction for directing flame upward toward at least one of said artificial firelogs;

and said non-burning artificial firelogs and said support frame being operably pivoted above said base and toward said flame directing member to raise said support frame and said non-burning artificial firelogs for the insertion and placement of a burning artificial firelog in said base;

said base further including first and second spaced apart legs and a bin operably effective for receiving a burning artificial log, said bin being supported by said legs; and said artificial firelog support frame includes a pair of downwardly extending flanges, one of said flanges being pivotally connected to one of said legs and the other of said flanges being pivotally connected to said bin.

2. A firelog burner as recited in claim 1, wherein:

said bin includes a plurality of apertures formed therein, said apertures being operably effective for letting ashes from a burning artificial firelog fall therethrough.

3. A firelog burner as recited in claim 1, further comprising:

a handle integral with said support frame and operably effective for facilitating the pivoting of said support frame relative to said base.

4. A firelog burner as recited in claim 1, wherein:

one of said pair of non-burning artificial firelogs is removably mounted on said first leg and the other of said non-burning artificial firelogs is removably mounted on said second leg.

5. A firelog burner as recited in claim 1, wherein:

said fire directing member extends upwardly from a rear wall of said bin.

6. A firelog burner as recited in claim 1, wherein:

said support frame includes a plurality of clips secured thereto;

each of said non-burning artificial firelogs has at least one aperture formed therein;

each of said clips are inserted into one of said apertures thereby removably mounting said firelogs to said support frame.

7. A firelog burner comprising:

a base including an elongated horizontally disposed firelog support frame, said frame having a pair of downwardly turned flanges at one end thereof defining support frame pivots, a pair of elongated, non-burning artificial firelogs removably mounted to said support frame;

said base further including an elongated burning firelog support floor, said base further including a fire directing member extending along a back thereof rearwardly of said flow and directed upwardly from said base for directing flame from a burning firelog upwardly toward at least one of said pair of non-burning artificial firelogs, and said non-burning artificial firelogs and said support frame thereunder being operably pivoted above said base between a burning firelog burning position over said floor and a burning firelog loading position over said fire directing member, wherein said pair of non-burning artificial firelogs and said support frame are pivotable from over said floor to said burning firelog loading position for loading a burning firelog on said floor.

8. A firelog burner as in claim 7 wherein said frame is cantilevered from said pair of flanges.

* * * * *